United States Patent [19]

Brookes

[11] Patent Number: 4,724,891

[45] Date of Patent: Feb. 16, 1988

[54] THIN WALL CASTING

[75] Inventor: Ronald R. Brookes, North Canton, Ohio

[73] Assignee: TRW Inc., Lyndhurst, Ohio

[21] Appl. No.: 813,247

[22] Filed: Dec. 24, 1985

[51] Int. Cl.[4] ..... B22D 27/04

[52] U.S. Cl. ..... 164/122.1; 164/516; 164/34

[58] Field of Search ..... 164/122.1, 122.2, 516, 164/34, 35, 137

[56] References Cited

U.S. PATENT DOCUMENTS 4,224,976 9/1980 Blazek ..... 164/137 X

FOREIGN PATENT DOCUMENTS 53-19290 6/1978 Japan ..... 164/122.1

OTHER PUBLICATIONS

Casting Design Handbook, American Society for Metals, 1962, Chapter 3, pp. 21–34.

*Primary Examiner*—Kuang Y. Lin

*Attorney, Agent, or Firm*—Tarolli, Sundheim & Covell

[57] ABSTRACT

An article having a thin wall portion with a thickness of 0.050 of an inch or less, and a surface area of at least 16 square inches is cast as one piece. A mold for the article has a pair of surface areas with a configuration corresponding to the configuration of the thin wall portion of the article and spaced apart by a distance of 0.050 of an inch or less. The mold surface areas have an extent of at least four inches along orthogonal axes with a total surface of at least 16 square inches. Although the extent of the surfaces may vary, depending upon the design of the article to be cast, the thin wall forming portion of the mold has a minimum extent or length, as measured from a center of the thin wall forming portion to the closest edge of the thin wall forming portion, such that the ratio of this minimum distance divided by the thickness is equal to at least 40.

21 Claims, 11 Drawing Figures

THIN WALL CASTING

BACKGROUND OF THE INVENTION

The present invention relates to a method of casting a thin wall, that is a wall with a thickness of 0.050 of an inch or less.

Attempts to cast a thin wall with substantial extents along each of two axes have failed. However, it may be possible to use prior art methods to cast a thin wall having a very long dimension along a first axis and a very short dimension along a second axis. Thus, if a rectangular wall is to have a length of 32 inches and a width of 0.5 inches with a thickness of 0.050 inches, it may be possible to cast the thin wall with prior art methods.

When the width or minimum dimension of the thin wall is large compared to the thickness of the thin wall, the thin wall cannot be cast using prior art methods. It is believed that a thin wall having a thickness of less than 0.050 inches cannot be cast, using prior art methods, when the distance (L) from the center of the thin wall to a closest edge of the thin wall divided by the thickness (T) of the thin wall is equal to 40 or more.

In the foregoing example wherein the width of the rectangular thin wall was 0.5 inches, the distance (L) from the center of the thin wall to a closest edge would be one half of the width or 0.25 inches. When a distance of 0.25 inches is divided by a thickness of 0.050 inches, the result is 5, indicating that it may be possible to cast this thin wall with prior art methods.

If the width of the thin wall in the foregoing example is increased to four inches, the distance (L) from the center of the thin wall to the closest edge would be two inches. When a distance of two inches is divided by a thickness of 0.050 inches, the result is 40, indicating that this thin wall cannot be cast with prior art methods. The difficulty encountered in casting a relatively wide thin wall using prior art methods increases as the thickness of the thin wall decreases.

The reason that a relatively wide thin wall cannot be cast using prior art methods is that the gating necesary to conduct molten metal into the mold cavity will tear or badly distort the thin wall as the mass of molten metal in the gating solidifies and cools. Therefore, thin walls having (1) a thickness of 0.050 of an inch or less, (2) a surface area of at least sixteen square inches, and (3) a minimum dimension across the surface of at least four inches have not been cast using prior art methods. The problem of making a thin wall having substantial extents in all directions from the center of a surface of the thin wall has previously been solved by casting a thick wall and then machining the wall to reduce its thickness.

SUMMARY OF THE PRESENT INVENTION

The present invention provides a method of making a casting having a relatively large thin wall, that is, a wall with an as cast thickness of 0.050 of an inch or less. The relatively large thin wall of the casting has a width or minimum surface dimension such that the distance from the center of the wall to a closest edge of the wall divided by the thickness of the wall is equal to 40 or more. Thus, the as cast surface of the thin wall of one specific article has major side surfaces with areas of at least sixteen square inches and has an extent of at least four inches along each axis of a pair of orthogonal axes.

In order to cast an article having a thin wall, a mold having a cavity with a configuration corresponding to the desired configuration of the cast article is formed. The mold cavity has a thin wall forming portion in which major side surfaces of the mold are spaced apart by a distance corresponding to the desired thickness of the thin wall portion of the article, that is, by a distance of 0.050 of an inch or less. After the mold has been preheated to a temperature close to the melting temperature of the metal which is to be cast, molten metal is poured into the mold. While the molten metal is being poured, the mold is heated so that molten metal can completely fill the mold cavity.

After the mold cavity has been completely filled with molten metal, the molten metal in the thin wall forming portion of the mold cavity is solidified to form a continuous solid body having a configuration corresponding to the configuration of the thin wall portion of the article. Thus, a thin wall which is free of voids and has a thickness of less than 0.050 of an inch is cast as the molten metal is solidified. To prevent the formation of voids as the molten metal solidifies, the molten metal is solidified in one direction by moving an interface between molten and solid metal in one direction through the thin wall forming portion of the mold cavity. The direction of solidification of the molten metal through the thin wall forming portion of the mold cavity is toward the gating or end portion of the mold cavity into which the molten metal was originally conducted.

Accordingly, it is an object of this invention to provide a new and improved method of casting an article having a thin wall, that is, an article having a wall with a thickness of 0.050 of an inch or less, and a substantial extent in all directions from a center of the thin wall.

BRIEF DESCRIPTION OF THE DRAWINGS

The foregoing and other objects and features of the present invention will become more apparent upon a consideration of the following description taken in connection with the accompanying drawings wherein.

DESCRIPTION OF SPECIFIC PREFERRED EMBODIMENTS OF THE INVENTION

Cast Article

Figure 1:
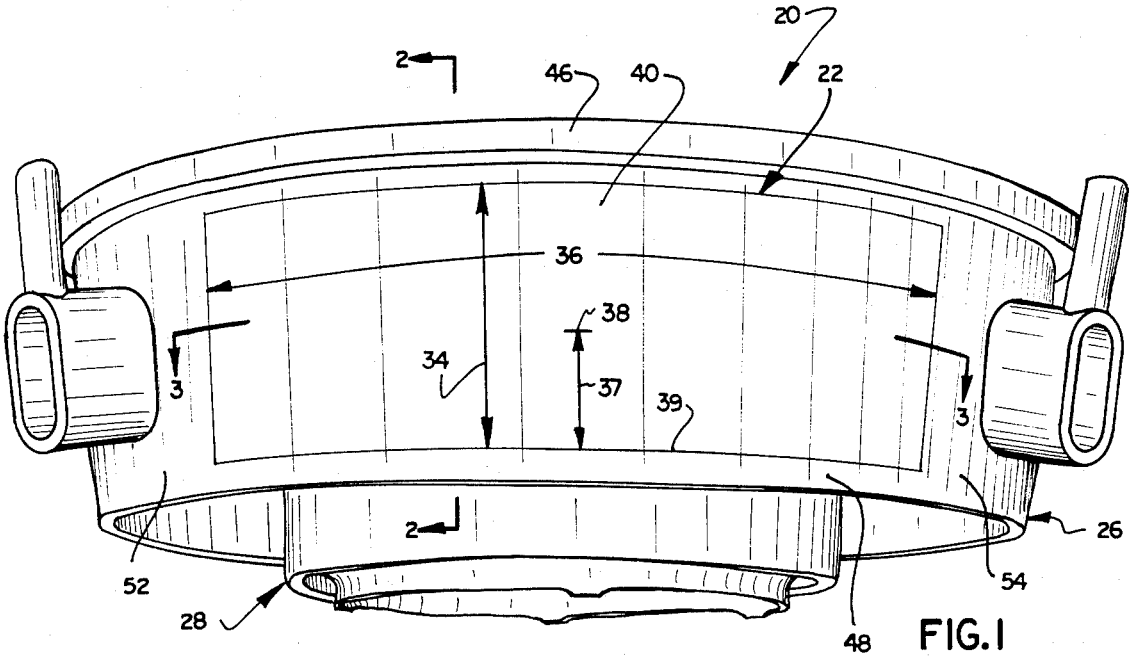
FIG. 1 is an illustration of a cast article having a thin wall portion.

A turbine engine component 20 (FIG. 1) having a thin wall portion 22 is cast as one piece with the method of the present invention. The cast turbine engine component 20 has a generally cylindrical outer wall 26 which circumscribes and is coaxial with a generally cylindrical inner wall 28. The inner and outer walls 26 and 28 are interconnected, in a known manner, by radially extending struts (not shown). It should be understood that although a turbine engine component has been illustrated in FIG. 1, it is contemplated that the method of the present invention could be used to cast articles other than turbine engine components.

Figure 2:
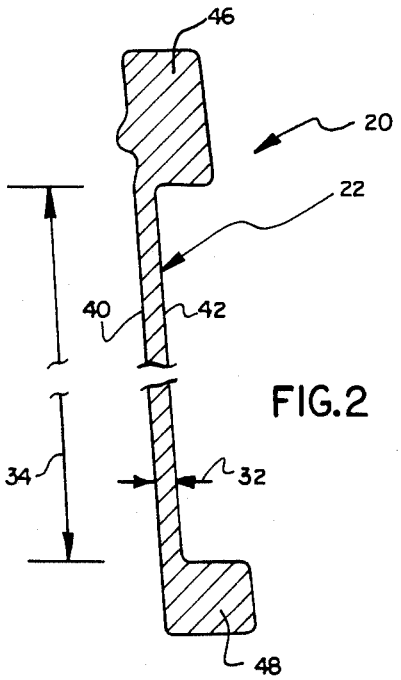
FIG. 2 is a sectional view, taken generally along the line 2—2 of FIG. 1, illustrating the configuration of the thin wall portion along a first axis.
Figure 3:
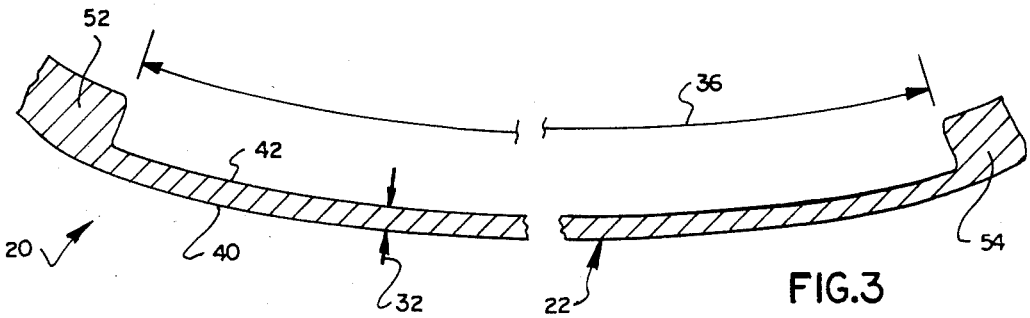
FIG. 3 is a section view, taken generally along the line 3—3 of FIG. 1, illustrating the configuration of the thin wall portion along a second axis which extends perpendicular to the first axis.

The thin wall portion 22 of the cast article 20 has an as cast thickness, indicated at 32 in FIGS. 2 and 3, of 0.050 of an inch or less. The as cast thin wall portion 22 has an axial extent indicated at 34 in FIGS. 1 and 2 and a circumferential extent indicated at 36 in FIGS. 1 and 2. The distance 37 from the center 38 of the thin wall portion 22 to a closest edge 39 of the thin wall portion divided by the thickness 32 is equal to forty or more.

In the turbine engine component 20, the axial and circumferential extents 34 and 36 of the thin wall portion 22 are such that the as cast inner and outer major side surfaces 40 and 42 each have a surface area of at least than 16 square inches. The side surfaces 40 and 42 each have an extent of at least four inches along each axis of a pair of orthogonal axes. Thus, the width 34 and length 36 are both at least four inches.

The thin wall portion 22 has a uniform thickness and extends axially between a relatively thick circular upper rim 46 and a relatively thick circular lower rim 48. In the turbine engine component 20, the thin wall portion 22 does not extend completely around the turbine engine component but is bounded by relatively thick side sections 52 and 54 which extend between rim sections 46 and 48. Although only one thin wall portion 22 has been shown in FIGS. 1-3, it should be understood that there are three identical thin wall portions equally spaced around turbine engine component 20.

The specific configuration and dimensions of a thin wall portion 22 of a turbine engine component 20 will vary with the design of the turbine engine component. In the illustrated turbine engine component 20, the axial extent 34 of the rectangular thin wall portion 22 is approximately six inches and the circumferential extent 36 is approximately sixteen inches. The thin wall portion 22 of the turbine engine component 20 is cast with parallel major side surfaces 40 and 42. The as cast surfaces 40 and 42 are separated by a uniform distance of 0.030 of an inch throughout their extent.

Although the thin wall portion 22 is rectangular and has a continuously curving cross sectional configuration (see FIG. 3), it is contemplated that the major side surfaces 40 and 42 of the thin wall portion could be formed with a different configuration. For example, the thin wall portion could have major sides 40 and 42 which are flat circles. In the case of a circular thin wall portion, the extent of the wall portion along each axis of a pair of orthogonal axes would be equal to the diameter of the circle. The quotient of the radius of the circle divided by the thickness of the thin wall portion would be forty or more.

The thin wall portion could be formed with a different thickness, for example, 0.010 of an inch. It should also be understood that the major side surfaces 40 and 42 of the thin wall portion 22 do not have to be parallel. However, if the distance between the major side surfaces 40 and 42 exceeds 0.050 of an inch, the resulting portion of the casting would not be considered as having a thin wall.

In order to enable the turbine engine component 20 to withstand the operating conditions to which it will be subjected, it is formed of a nickel-chrome superalloy, such as the commercially available IN 718. Since the illustrative turbine engine component 20 is subjected to relatively large circumferential or hoop stresses, the turbine engine component 20 is formed with an equiaxed grain structure, that is a grain structure having numerous randomly oriented crystals. However, it is contemplated that the article 20 could be cast of a different metal and could have a different crystalline structure, for example, a columnar grain structure.

Regardless of the specific kind of article in which a thin wall is cast, it is contemplated that the thin wall will have a relatively large surface area compared to its thickness. Thus, the opposite major side surfaces 40 and 42 of the as cast thin wall portion 22 have a minimum extent from a center of the thin wall portion to one edge of the thin wall portion such that the ratio of this minimum extent to the thickness is at least forty.

In the illustrated thin wall portion 22, the minimum distance from the center of the rectangular thin wall portion to one edge would be one half of the total axial extent 34 of the thin wall portion 22, that is, approximately three inches. The thickness of the thin wall portion 22 is 0.030 inches. The ratio of the minimum distance from the center of the thin wall portion 22 to an edge of the thin wall portion would be 3/0.030 or 100. Of course, if the thickness of the thin wall portion was increased, to a maximum thickness of 0.050 of an inch, and the shortest distance from a center of the thin wall portion to an edge was reduced to a minimum of two inches, this ratio would decrease to a minimum of forty.

As used herein, the term thin wall portions relates only to a wall having an as cast thickness of 0.050 or less. Each side 40 or 42 of a thin wall portion has a substantial surface area. At least certain thin walls formed by the present invention have side surfaces 40 and 42 with the surface areas of each side being greater than sixteen square inches with a minimum dimension 34 of at least four inches. Regardless of the actual size of the surfaces and thickness of the thin wall, the ratio of the distance from the center of a thin wall portion to the closest edge of the as cast thin wall portion to the thickness is equal to forty or more. Attempts to cast thin wall portions meeting the foregoing criteria and using conventional casting techniques have failed.

Although the thin wall portion 22 is framed by the relatively thick portions 46, 48, 52 and 54, it is contemplated that one or more of these thick portions could be eliminated if desired. For example, the upper rim 46 and/or the side sections 52 and 54 could be eliminated. One specific thin wall casting formed in accordance with the present invention has coaxial cylindrical inner and outer side surfaces. The casting had a length of approximately 6 inches and an outside diameter of approximately 8.2 inches. The casting had a thickness of 0.030 inches throughout the extent of the casting. Thus, the cylindrical inner and outer side surfaces of the casting were spaced apart by 0.030 inches throughout the extent of the surfaces.

Mold Formation

Figure 4:
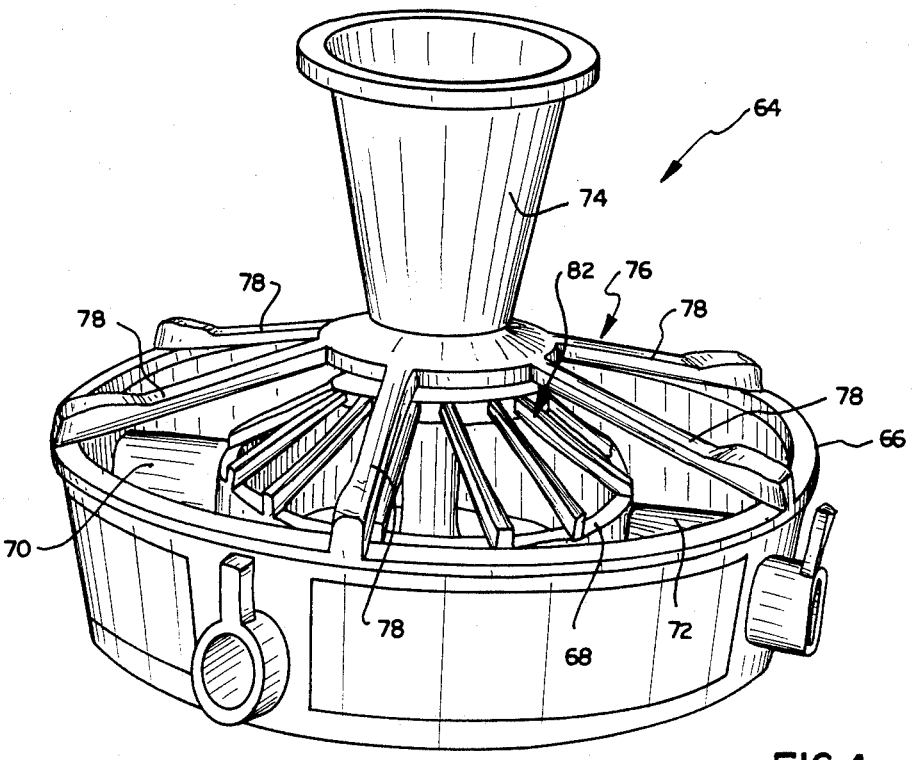
FIG. 4 is a pictorial illustration of a pattern used to form the mold to cast the article of FIG. 1.
Figure 5:
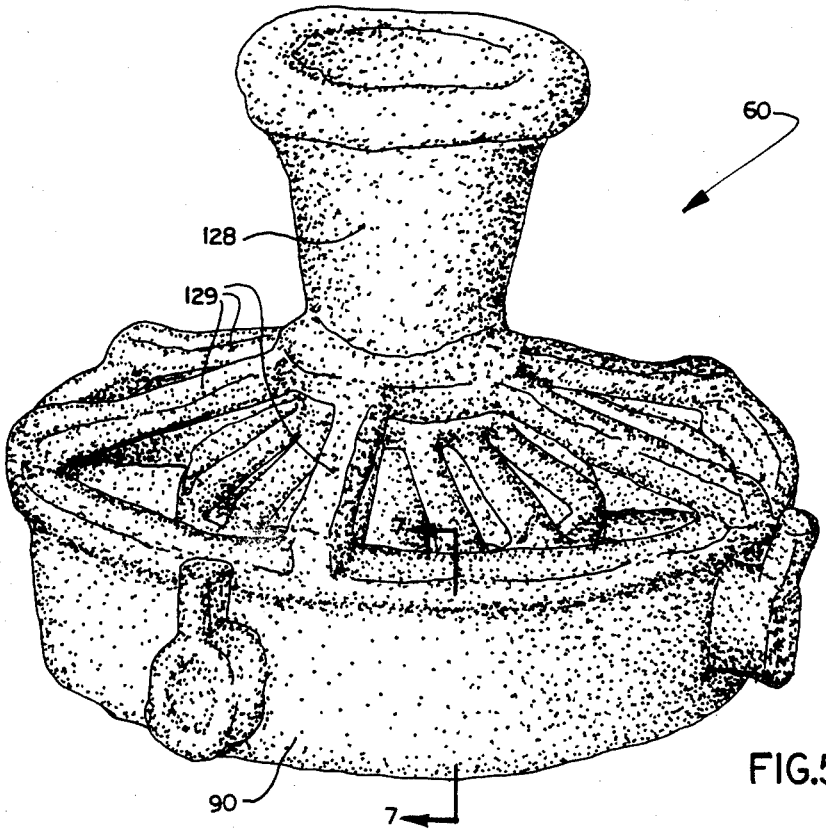
FIG. 5 is a pictorial illustration of a mold made with the pattern of FIG. 4.

A ceramic mold 60 (FIG. 5) can be used to cast the article 20 of FIG. 1. To make the mold 60, a wax pattern 64 (FIG. 4) is first constructed. The wax pattern 64 may be formed of natural or synthetic wax materials. The wax materials are injection molded in dies to form various parts of the pattern 64. The molded wax parts are then interconnected to form the complete pattern.

The pattern 64 includes a circular outer wall 66 having the same configuration as the circular outer wall 26 of the article 20. Similarly, the pattern 64 has a circular inner wall 68 having the same configuration as the inner wall 28 of the pattern. Wax struts 70 and 72 interconnect the inner and outer walls 66 and 68 of the pattern 64.

A wax pour cup pattern 74 is connected with the upper end portion of the outer wall section 66 by a gating pattern 76. The gating 76 includes a plurality of relatively thin runners 78 which extend radially outwardly from the pour cup to the outer wall 66. It should be noted that the gating pattern 76 extending to the upper end portion of the outer wall 66 is the only gating pattern provided for the outer wall and that the outer wall is free of any other gating. A suitable gating pattern 82 connects the pour cup 74 with the inner wall 68.

The pattern 64 has a configuration corresponding to the configuration of the cast article 20. A pattern for a different article having a thin wall would have a configuration corresponding to the configuration of that article. Thus, the pattern for a cylindrical thin wall casting having a uniform thickness of 0.030 of an inch throughout its axial extent was formed by a hollow wax cylinder having a wall thickness of 0.030 inches. This particular cylindrical pattern had an outside diameter of 8.2 inches and an axial length of approximately 6 inches.

To form the mold 60, the entire wax pattern 64 is repetitively dipped in a slurry of ceramic mold material. After the wax pattern 64 has been repetitively dipped and dried to form a covering of a desired thickness over the pattern, the covering and pattern are heated to a temperature sufficient to melt the wax forming the pattern. This wax is then drained from the covering of ceramic mold material to leave the mold 60. The mold 60 could be dewaxed by any other methods, including using solvents or microwave energy.

The slurry of ceramic mold material contains fused silica, zircon and other refractory materials in combination with binders. Chemical binders such as ethyl silicate, sodium silicate and colloidal silica can be utilized. In addition, the slurry of ceramic mold material may contain suitable filim formers such as alginates to control viscosity and wetting agents to control flow characteristics and pattern wettability.

In accordance with common practice, the initial slurry coating applied to the pattern 64 contains a very finely divided refractory material to produce an accurate surface finish. A typical slurry for a first coat may contain approximately 29% colloidal silica suspension in the form of a 20–30% concentrate. Fused silica of a particle size of 325 mesh or smaller in an amount of 71% can be employed, together with less than 1–10% by weight of a wetting agent. Generally, the specific gravity of the slurry of the ceramic mold material may be on the order of 1.75 to 1.80 and have an viscosity of 40–60 seconds when measured with a Number 5 Zahn cup at 75° to 85° F. After the application of the initial coating, the surface is stuccoed with refractory materials having particle sizes on the order of 60 to 200 mesh.

In accordance with well known procedures, each dip coating is at least partially dried before subsequent dipping of the pattern 64. The pattern 64 is repetitively dipped and dried enough times to build up a covering of ceramic mold material of a desired thickness. After dewaxing, the mold is fired at a temperature of approximately 1900° F. to cure the mold material and form the mold 60 of FIG. 5.

The mold 60 has a cavity with a configuration which corresponds to the configuration of the wax pattern 64. Thus, the upper portion of the mold cavity will contain passages corresponding to the gating patterns 76 and 82. The main or article forming portion of the mold cavity will have a configuration corresponding to the configuration of the article 20. Thus, the mold 60 has a circular outer wall 90 with a cavity 92 (see FIG. 7) having a configuration corresponding to the configuration of the outer wall 26 of the article 20.

The cavity 92 includes an annular portion 94 having a configuration corresponding to the configuration of the upper rim 46 of the article and an annular portion 96 with a configuration corresponding to the configuration of the lower rim 48 of the article. A rectangular thin wall forming portion 100 of the cavity 92 has a configuration corresponding to the rectangular configuration of the thin wall portion 22 of the article. The thin wall portion 100 (FIG. 7) of the cavity 92 is partially defined by a pair of parallel mold surfaces 104 and 106 having configurations corresponding to the major sides 42 and 44 of the thin wall portion 22 (FIG. 2).

The mold surfaces 104 and 106 (FIG. 7) are spaced apart by a distance corresponding to the thickness 32 of the thin wall portion 22. Thus, the parallel mold surfaces 104 and 106 are spaced apart by a distance which is 0.050 of an inch or less. Since the surfaces 40 and 42 of the thin wall portion 22 are spaced apart by 0.030 inches, the mold surfaces 104 and 106 are also spaced apart by 0.030 inches.

The mold surfaces 104 and 106 have axial and circumferential extents corresponding to the axial and circumferential dimensions 34 and 36 of the thin wall portion 22 of the article 20. Thus, the mold surfaces 104 and 106 both have an area which is greater than 16 square inches and have a minimum dimension, that is an axial dimension, which is at least four inches. Since the surfaces 40 and 42 of the thin wall portion 22 have an axial extent of approximately six inches and a circumferential extent of approximately sixteen inches, the mold surfaces 104 and 106 have an axial extent of approximately six inches and a circumferential extent of approximately sixteen inches.

The ratio of the shortest distance from a center of the surfaces 104 and 106 to an edge of the thin wall forming portion 100 of the mold cavity 92 to the thickness of the thin wall forming portion is equal to at least 40. Thus, if the distance between the surfaces 104 and 106 was 0.050 inches, the shortest distance from the center of either one of the surfaces to the edge of the thin wall forming portion of the mold cavity measured along the surfaces, would be at least two inches.

Figure 7:
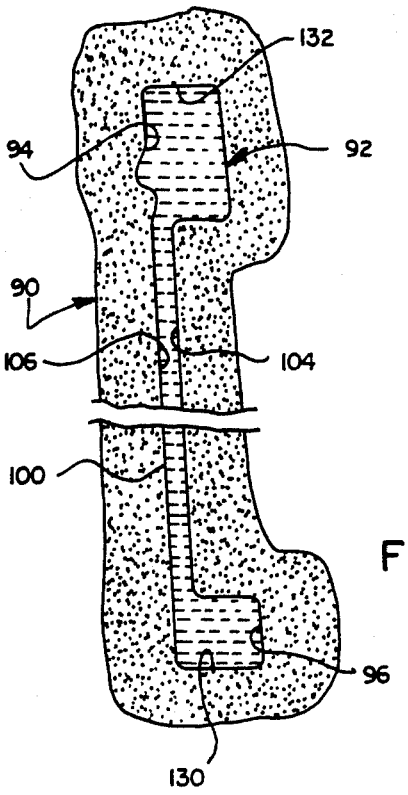
FIG. 7 is a sectional view, taken generally along the line 7—7 of FIG. 5, illustrating how molten metal completely fills the thin wall forming portion of a mold cavity.

Although the mold surfaces 104 and 106 have been shown in FIG. 7 as being parallel to each other, in the same manner as the surfaces 40 and 42 of the thin wall section 22 of the article 20, the mold surfaces 104 and 106 could be skewed slightly relative to each other. Thus, the distance between the surfaces at the upper rim forming portion 92 could be 0.10 of an inch while the distance between the surfaces at the lower rim forming portion 96 could be 0.050 of an inch. However, the distance between the surfaces 104 and 106 in the thin wall forming section of the mold 60 would not exceed 0.050 of an inch. It should be noted that the thin wall forming portion 100 of the mold cavity 92 is free of gating.

Casting an Article

Figure 6:
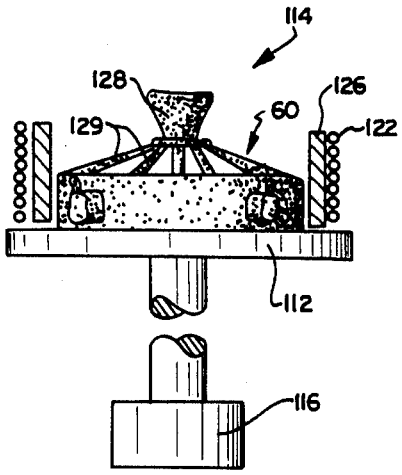
FIG. 6 is a schematic illustration of the mold of FIG. 5 in a furnace in which molten metal is poured into the mold.

When the mold 60 is to be used to cast an article, it is placed on a circular support plate 112 (see FIG. 6) and raised into a furnace 114 by operation of a drive mechanism 116. The furnace 114 has a known construction which includes a cylindrical coil 122 and an inner graphite susceptor 126. The coil 122 is energized to heat the mold 60. The entire furnace 114 is enclosed within a housing (not shown) which encloses a laddle of molten metal and can be evacuated. The general construction of the furnace is the same as is shown in U.S. Pat. No. 3,841,384.

Once the mold 60 has been preheated to a temperature close to the melting temperature of the metal from which the article 20 is to be formed, molten metal is poured from the laddle (not shown) into a pour cup 128 of the mold 60. During the pouring of the molten metal, the coil 122 is energized so that heat is conducted from the furnace 114 to the mold 60 to maintain the metal in the mold in a molten state. In one specific instance, the mold 60 was preheated to a temperature of approximately 2650° F. and molten nickel-chrome superalloy, specifically IN 718, was heated to 2650° F. and poured into the mold.

The molten metal was conducted from the pour cup 128 to the mold cavity 92 for the outer wall through only gating 129 connected with the upper end portion of the mold cavity. This results in a downward (as viewed in FIG. 7) flow of molten metal into the mold cavity 92 to completely fill the mold cavity. Since heat is being supplied to the preheated mold 60 during pouring, the metal in the mold cavity 92 remains molten during and immediately after pouring. This enables the molten metal to completely fill the restricted space between the mold surfaces 104 and 106 in the thin wall forming section 100 of the mold cavity 92.

After the mold 60 has been filled with molten metal, the molten metal is solidified, throughout its circumferential extent, in a direction toward the gating 129 through which the metal was supplied to the mold cavity 92. Thus, molten metal is solidified from an annular bottom surface 130 at a closed lower end of the mold 60 upwardly toward an annular top surface 132 which is connected with the gating 129. This directional solidification of the molten metal in the mold cavity 92 is accomplished by lowering the support 112 to gradually withdraw the mold 60 from the furnace 122. The directional solidification could be accomplished by reducing the amount of heat produced by the coil 122 in a manner to promote directional solidification.

Figure 8:
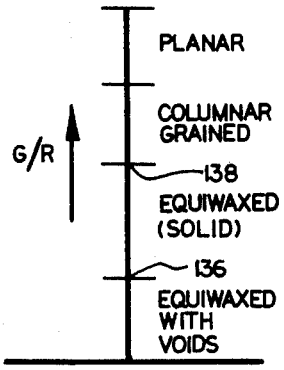
FIG. 8 is a graph depicting the relationship between the type of cast metal obtained during solidification of molten metal and the ratio of the thermal gradient through which the molten metal is solidified to the rate of solidification.

The mold 60 is withdrawn from the coil 122 at a rate (R) such that the molten metal in the mold cavity 92 solidifies as a continuous solid body which is free of voids. Since it is desired to form the article 22 with an equiaxed crystalline grain structure, the rate of withdrawal of the mold 60 was fast enough to avoid the formation of a columnar grain structure and slow enough to prevent the formation of voids. Thus, the ratio of the temperature gradient (G) between the inside and outside of the furnace 114 to the rate of withdrawal of the mold 60 from the furnace (G/R) was between the values indicateed graphically at 136 and 138 in FIG. 8. Of course, if a columnar grained structure was desired, the rate of withdrawal of the mold would have been reduced.

Figure 9:
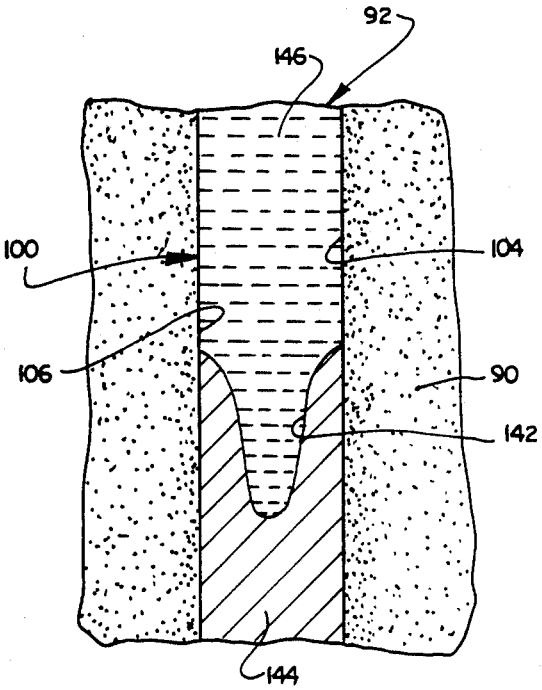
FIG. 9 is a sectional view of a thin wall forming portion of a mold cavity and schematically illustrating the interface between molten and solid metal.

As the molten metal in the mold cavity 92 solidifies between the surfaces 104 and 106 to form the thin wall portion 22 of the article 20, an interface 142 (see FIG. 9) between solid metal, indicated at 144, and molten metal, indicated at 146, moves continuously upwardly between the side surfaces 104 and 106. The molten metal 146 does not solidify ahead of the interface to prevent the formation of shrinkage voids. Therefore the molten metal solidifies as a continuous solid body.

Since an equiaxed grain structure was desired, the surface of the mold cavity contained an innoculant to promote the formation of crystals. Cobalt aluminate was used as the innoculant. However, other innoculants could be used to promote fine grain formation.

Once all of the molten metal in the mold cavity 92 has been solidified, the mold 60 is removed from the furnace and cooled. The ceramic mold material is removed from the resulting casting. The gating is also removed from the casting to provide the one piece cast article 20.

Segmented Mold

Figure 10:
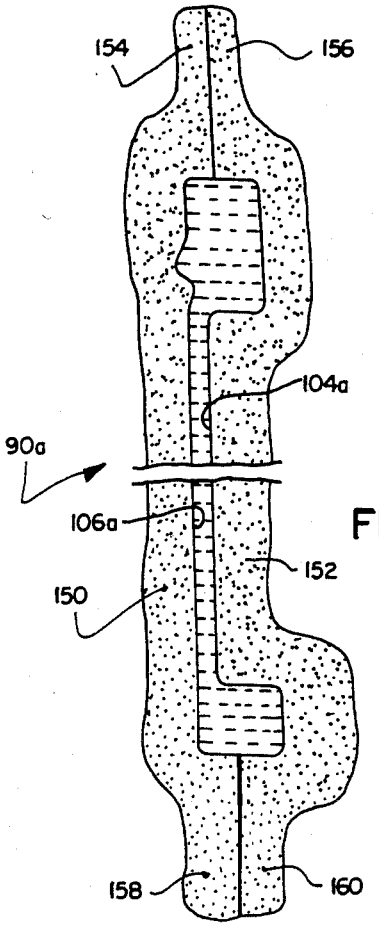
FIG. 10 is a sectional view, generally similar to FIG. 7, illustrating an embodiment of the mold in which a pair of mold sections are interconnected to form a portion of a mold cavity.

In the foregoing description, the mold 60 was described as being formed as one piece by repetitively dipping a wax pattern 64 in a slurry of ceramic mold material. However, it is contemplated that the mold 60 could be formed by interconnected mold sections in the manner shown in FIG. 10. Since the embodiment of the invention shown in FIG. 10 is generally similar to the embodiment of the invention shown in FIGS. 1–9, similar numerals will be utilized to designate similar components, the suffix letter "a" being associated with the numerals in FIG. 10 to avoid confusion.

A mold **90*a* for the outer wall 26 (FIG. 1) of the article 20 is formed by a pair of mold sections 150 and 152 which are disposed in abutting engagement and are interconnected at upper end portions 154 and 156 and at lower end portions 158 and 160. The mold section 150 is formed by providing a pattern having a surface with a configuration corresponding to the configuration of the inner side surface of the mold section, including the flat side surfaces on the upper and lower end portions 154 and 158**. The wax pattern is also provided with a nonfunctional surface which circumscribes the edges of the surfaces having a configuration corresponding to the configuration of a side surface of the pattern.

The pattern is repetitively dipped in a ceramic slurry and the nonfunctional surface wiped after each dipping. The layer of ceramic mold material overlying the pattern is then partially dried and separated from the pattern. The ceramic mold material is then fired to form the section 150. The mold section 152 is formed in the same way as the mold section 150. A more detailed description of the manner in which the mold sections 150 and 152 are formed is set forth in U.S. Pat. No. 4,066,116.

Since the pattern sections 150 and 152 are formed separately from each other, the surface areas which form the thin wall portion of the cast article can be inspected before the mold is filled with molten metal. In addition, the separate mold sections can be accurately shaped and interconnected. This enables the mold surfaces 104*a* and 106*a* which form the thin wall section of the article to be accurately located relative to each other.

Second Embodiment of Cast Article

Figure 11:
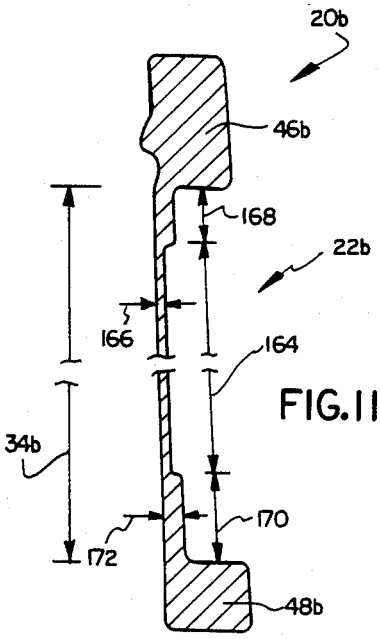
FIG. 11 is a sectional view, generally similar to FIG. 2, illustrating the cross sectional configuration of a thin wall portion of another embodiment of the cast article.

In the embodiment of the cast article shown in FIGS. 1–3, the thin wall portion 22 has side surfaces 40 and 42 which are spaced the same distance from each other throughout the length and width of the thin wall portion 22. In the embodiment of the thin wall portion shown in FIG. 11, the thin wall portion has two different thicknesses. Since the embodiment of the invention shown in FIG. 11 is generally similar to the embodiment of the invention shown in FIGS. 1–3, similar numerals will be utilized to designate similar components, the suffix letter "b" being associated with the numerals in FIG. 11 to avoid confusion.

The thin wall portion 22*b* of a cast article 20*b* is disposed between relatively thick upper and lower rim portions 46*b* and 48*b*. The thin wall portion 22*b* has an axial extent 34*b* which is the same as the axial extent 34 of the thin wall portion 22 of FIGS. 1 and 2. In addition, the thin wall portion 22*b* has a circumferential extent which is the same as the circumferential extent 36 of the thin wall portion 22.

The thin wall portion 22*b* has a thickness of 0.050 of an inch or less throughout the extent of the thin wall portion 34*b*. However, the thin wall portion 34*b* has a central section 164 with a relatively small thickness 166 and a pair of outer portions 168 and 170 with a relatively large thickness. The thickness 172 of the portions 168 and 170 is greater than the thickness of the portion 164 but less than 0.050 of an inch. Thus in one specific example, the thickness 166 is 0.020 of an inch while the thickness 172 is 0.40 of an inch.

Although the major side surfaces of the sections 164, 168 and 170 extend parallel to each other, it is contemplated that one or more of the side surfaces could be skewed. For example, the inner side surface of the section 164 could slope from a relatively large thickness 172 at the section 168 to a relatively small thickness 166 at the section 170. The making of the thin wall portion 22*b* with any desired configuration is faciliated when the mold is formed of separate segments in the manner illustrated in FIG. 10.

Conclusion

The present invention provides a method of making a cast article 20 having relatively large thin wall 22, that is a wall with a thickness of 0.050 of an inch or less. The relatively large thin wall 22 of the casting 20 has a width or minimum surface dimension 34 such that the distance 37 from the center of the surface to a closest edge 39 of the thin wall divided by the as cast thickness of the thin wall is equal to forty or more. Thus, the as cast thin wall 22 has major side surfaces 40 and 42 with areas of at least sixteen square inches and with extents of at least four inches along each axis of a pair of orthogonal axes.

In order to make the casting 22, a mold 60 having a mold cavity with a configuration corresponding to the desired configuration of the cast article is formed. The outer wall forming mold cavity 92 has a thin wall forming portion 100 in which major side surfaces 104 and 106 of the mold 60 are spaced apart by a distance corresponding to the desired thickness of the thin wall portion 22 of the article 20, that is, by a distance of 0.050 of an inch or less. After the mold 60 has been preheated to a temperature close to the melting temperature of the metal which is to be cast, molten metal is poured into the mold. While the molten metal is being poured, the mold 60 is heated so that molten metal can completely fill the mold cavity.

After the mold cavity 92 has been completely filled with molten metal, the molten metal in the thin wall forming portion 100 is solidified to form a continuous solid body having a configuration corresponding to the configuration of the thin wall portion 22 of the article 20. Thus, a thin wall portion 22 which is free of voids and has a thickness of less than 0.050 of an inch is cast as the molten metal is solidified. To prevent the formation of voids as the molten metal solidifies, the molten metal 146 (FIG. 9) is solidified in one direction by moving an interface 142 between molten and solid metal in one direction through the thin wall portion of the mold cavity, that is, upwardly as viewed in FIG. 9. The direction of solidification of the molten metal 146 through the thin wall forming portion 100 of the mold cavity 92 is toward the gating 129 through which the molten metal was originally conducted.

Although one specific cast article 20 having a thin wall portion 22 has been illustrated in FIG. 1, it should be understood that articles having substantially different configurations could be formed in accordance with the present invention.

Having described specific preferred embodiments of the invention, the following is claimed:

1. A method of casting an article having a thin wall portion with a thickness of 0.050 of an inch or less and a surface area of at least sixteen square inches, said method comprising the steps of providing a mold having a pair of surface areas spaced apart by 0.050 of an inch or less with each of the surface areas has an extent of at least four inches along each axis of a pair of orthogonal axes and a total surface area of at least sixteen square inches, flowing molten metal into the space between the pair of surface areas, and solidifying the molten metal as a continuous solid body in the space between the surface areas, said step of solidifying the molten metal includes solidifying the molten metal in a direction extending generally parallel to one of the orthogonal axes.

2. A method as set forth in claim 1 wherein said step of providing a mold includes the step of providing a mold having a mold cavity which is closed at a first end portion and is open to gating at a second end portion opposite from said first end portion, said mold being free of gating between the first and second end portions of said mold, said step of flowing molten metal into the space between the pair of surface areas includes flowing molten metal into the mold cavity from only the second end portion in a direction toward the first end portion of the mold cavity, said step of solidifying the molten metal includes initiating solidification of the molten metal in the first end portion of the mold cavity and solidifying the molten metal from the first end portion of the mold cavity to the second end portion of the mold cavity.

3. A method as set forth in claim 2 further including the step of completely filling the mold cavity with molten metal prior to performing said step of initiating solidification of the molten metal in the first end portion of the mold cavity.

4. A method as set forth in claim 3 further including the step of preheating the mold to a temperature which is close to the melting temperature of the molten metal before performing said step of flowing molten metal into the space between the pair of surface areas.

5. A method as set forth in claim 4 further including the steps of placing the mold in a furnace and conducting heat from the furnace to the mold during performance of said step of flowing molten metal into the space between the pair of surface areas, said step of solidifying the molten metal including conducting heat from the molten metal at a rate which is slow enough to prevent the formation of voids during solidification of the molten metal and fast enough to result in solidification of the majority of the molten metal between the pair of surface areas with an equiaxed grain structure.

6. A method as set forth in claim 1 wherein said step of flowing molten metal into the space between the pair of surface areas includes conducting a flow of molten metal into the space from only one direction.

7. A method as set forth in claim 1 wherein said step of providing a mold includes providing a mold having gating adjacent to only one end portion of the space between the pair of surface areas.

8. A method as set forth in claim 1 wherein said step of providing a mold having a pair of surface areas includes providing a mold having a pair of surface areas which extend parallel to each other.

9. A method as set forth in claim 1 wherein said step of providing a mold having a pair of surface areas includes providing a mold in which the pair of surface areas has a continuously curving configuration along at least one of the orthogonal axes.

10. A method as set forth in claim 1 wherein said step of providing a mold having a pair of surface areas includes providing a mold having a pair of surface areas which are spaced apart by the same distance throughout the extent of the surface areas.

11. A method as set forth in claim 1 wherein said step of providing a mold having a pair of surface areas includes providing a mold having a pair of surface areas with a first portion of the surface areas spaced apart by a first distance and a second portion of the surface areas spaced apart by a second distance which is less than the first distance, said first distance being 0.050 of an inch or less.

12. A method as set forth in claim 1 wherein said step of providing a mold includes providing a mold having gating at one end portion of the mold with all areas of the mold other than the one end portion being free of gating.

13. A method as set forth in claim 1 wherein said step of providing a mold includes forming a first mold section with at least a portion of one surface area of the pair of surface areas disposed thereon, forming a second mold section with at least a portion of another surface area of the pair of surface areas thereon, and interconnecting the first and second mold sections to at least partially define a mold cavity having a configuration corresponding to the configuration of at least a portion of the thin wall portion of the article.

14. A method of casting an article at least a portion of which has a thin wall, said method comprising the steps of making a mold having a mold cavity with a configuration corresponding to the configuration of the article, said step of making a mold including forming at least a portion of the mold cavity with a configuration corresponding to the configuration of the thin wall portion of the article by:

(1) forming the thin wall portion of the mold cavity with a thickness (T) of 0.050 of an inch or less throughout the extent of the thin wall portion of the mold cavity, and (2) forming the thin wall portion of the mold with a length (L) as measured in inches from the center of the thin wall portion of the mold cavity to the closest edge of the thin wall portion of the mold cavity such that the ratio of length to thickness (L/T) is equal to at least 40, filling the entire mold cavity with molten metal, and, thereafter, solidifying the molten metal in the thin wall portion of the mold cavity by moving an interface between molten metal and solid metal in one direction through the thin wall portion of the mold cavity.

15. A method as set forth in claim 14 wherein said step of filling the mold cavity with molten metal includes the step of flowing molten metal into the thin wall portion of the mold cavity only in a direction opposite to the one direction.

16. A method as set forth in claim 14 wherein said step of moving the interface between the molten metal and solid metal in the one direction includes moving the interface in the one direction at a rate which is slow enough to result in solidification of the molten metal in the thin wall portion of the mold cavity without the formation of voids in the solidified metal.

17. A method as set forth in claim 14 wherein said step of forming the thin wall portion of the mold cavity includes forming a first mold section with one surface area disposed thereon, forming a second mold section with another surface area thereon, and interconnecting the first and second mold section with the surface areas facing each other and spaced apart by 0.050 of an inch or less to at least partially define the mold cavity.

18. A method as set forth in claim 14 wherein said step of providing a mold includes providing a mold having gating at one end portion of the mold with all areas of the mold other than the one end portion being free of gating.

19. A one-piece cast metal article comprising a thin wall portion having an as cast thickness of 0.050 of an inch or less and a pair of major side surfaces, each of said major side surfaces having as cast surface areas of at least sixteen square inches with each of the as cast surface areas having an extent of at least four inches along each axis of a pair of orthogonal axes, said metal article having been formed by a process which includes providing a mold having a mold cavity with a configuration corresponding to the configuration of the article, said mold cavity including a thin wall forming portion which is at least partially defined by a pair of mold surfaces which are spaced apart by a distance of 0.050 of an inch or less, flowing molten metal into the space between the pair of mold surfaces, and solidifying the molten metal as a continuous solid body in the space between the pair of mold surfaces.

20. A one-piece cast metal article comprising a thin wall portion having an as cast thickness (T) of 0.050 of an inch or less and a pair of major side surfaces having as cast surface areas with a length (L) as measured in inches from a center of a surface area to the closest edge of the thin wall portion such that the ratio of length to thickness (L/T) is equal to at least 40, said metal article having been formed by a process which includes providing a mold having a mold cavity with a configuration corresponding to the configuration of the article, said mold cavity including a thin wall forming portion which is at least partially defined by a pair of mold surfaces which are spaced apart by a distance of 0.050 of an inch or less and have surfaces with configurations corresponding to the configurations of the surface areas of the thin wall portion of the cast article, flowing molten metal into the space between the pair of mold surfaces, and solidifying the molten metal as a continuous solid body in the space between the pair of mold surfaces.

21. A method of casting a nickel-chrome superalloy article having a thin wall portin with a thicknes of 0.050 of an inch or less and a surface area of at least sixteen square inches, said method comprising the steps of providing a mold having first and second surface areas spaced apart by 0.050 of an inch or less with each of the surface areas has an extent of at least four inches along each axis of a pair of orthogonal axes and a total surface area of at least sixteen square inches, said step of providing a mold including the steps of providing a pattern having a pair of said surface areas spaced apart by 0.050 of an inch or less with each of the pattern surface areas having an extent of at least four inches along each axis of a pair of orthogonal axes and a total surfce area of at least sixteen square inches, applying a coating of ceramic mold material over the pattern, and disposing of the pattern after performing said step of applying a coating over the pattern to provide a mold cavity which is at least partially defined by said first and second surface areas and is open to gating only at an upper end portion of said mold cavity, preheating the mold to a temperature which is close to the melting temperature of the nickel-chrome superalloy, flowing molten metal into the space between the first and second surface areas, said step of flowing molten metal into the space between the first and second surface areas includes the step of conducting a flow of molten nickel-chrome superalloy into the mold cavity from only the gating at the upper end portion of the mold cavity, and solidifying the molten nickel-chrome superalloy as a continuous solid body in the space between the first and second surface areas, said step of solidifying the molten nickel-chrome superalloy includes solidifying the molten metal in a direction extending upwardly from a lower end portion of the mold and generally parallel to one of the orthogonal axes.

* * * * *